United States Patent [19]

Berkman et al.

[11] 4,251,206

[45] Feb. 17, 1981

[54] APPARATUS FOR AND METHOD OF SUPPORTING A CRUCIBLE FOR EFG GROWTH OF SAPPHIRE

[75] Inventors: Samuel Berkman, Florham Park; Robert Metzl, Hamilton Square; Richard E. Novak, E. Windsor, all of N.J.; David L. Patterson, Mountaintop, Pa.

[73] Assignee: RCA Corporation, New York, N.Y.

[21] Appl. No.: 38,829

[22] Filed: May 14, 1979

[51] Int. Cl.[3] ..... F27D 5/00

[52] U.S. Cl. ..... 432/5; 156/608; 422/248; 432/253

[58] Field of Search ..... 432/5, 262, 265, 253

[56] References Cited

U.S. PATENT DOCUMENTS

| | | |
|---|---|---|
| 3,096,083 | 7/1963 | Keon . |
| 3,291,650 | 12/1966 | Dohmen et al. . |
| 3,549,847 | 12/1970 | Clark . |
| 3,607,112 | 9/1971 | Mermelstein . |
| 3,845,738 | 11/1974 | Berkman et al. . |
| 3,868,228 | 2/1975 | Mlavsky et al. . |
| 3,898,051 | 8/1975 | Schmid . |
| 3,980,854 | 9/1976 | Berkman et al. . |
| 4,075,055 | 2/1978 | Ciszek et al. . |
| 4,099,041 | 7/1978 | Berkman et al. . |

*Primary Examiner*—Henry C. Yuen

*Attorney, Agent, or Firm*—Birgit E. Morris; Donald S. Cohen; Robert P. Seitter

[57] ABSTRACT

A crucible for containing a melt and die for EFG growth of sapphire is supported by a pyrolytic graphite crucible support plate having the C axis of the pyrolytic graphite perpendicular to the bottom of the crucible which is supported by the plate. This thermally insulates the crucible from the pedestal which supports the support plate.

16 Claims, 1 Drawing Figure

APPARATUS FOR AND METHOD OF SUPPORTING A CRUCIBLE FOR EFG GROWTH OF SAPPHIRE

BACKGROUND OF THE INVENTION

1. Field of the Invention

The invention relates to the field of supporting EFG crystal growth crucibles which are maintained at very high temperatures in the vicinity of about 2000° C. or higher during the growth of crystals therefrom.

2. Prior Art

Crucible support systems which comprise a quartz tube supporting a graphite susceptor which in turn supports the crucible are known in the art for supporting EFG (Edge-defined Film-fed Growth) crucibles which are maintained at high temperatures, such as those in the neighborhood of 1200° C. Unfortunately, such crucible support systems are not feasible for use at temperatures higher than about 1300° C. because the softening or annealing temperature (1140° C.) of the quartz is exceeded to an extent that the quartz deforms enough that it no longer provides a sufficiently stable support.

Prior art support systems for EFG crucibles which are maintained at very high temperatures for the growth of very high melting point crystals such as sapphire (melting point 2054° C.) have utilized rods of refractory metals such as tungsten to support the crucible. Such support systems are inadequate for the highest quality crystal growth of wide ribbons because even refractory metals soften enough when exposed to these very high crystal growth temperatures that they bend excessively. Further, refractory metals have substantial coefficients of thermal expansion (tungsten's is $5.5\times10^{-6}$ in/in/degree C.). As the temperature of the support rods increases, its expansion causes the position of the crucible and thus the position of the die top to change enough to make the control of the crystal growth even more difficult than it already is. Because of the large thermal gradients present in an EFG growth furnace, even a small change in the position of the die top within the furnace thermal profile can have a drastic effect on the crystal growth conditions at the liquid-solid interface where the crystal growth takes place.

SUMMARY

The above discussed problems of the prior art crucible support systems are overcome in accordance with the present invention by providing a pyrolytic graphite crucible support plate having its C axis substantially perpendicular to the bottom of the crucible it supports. The crucible may either sit directly or indirectly on the crucible support plate. A pedestal which is substantially stable at the temperatures to which it is exposed supports the pyrolytic graphite crucible support plate. The pyrolytic graphite thermally insulates the pedestal from the crucible. This pedestal is preferably a clear fused silica tube.

DETAILED DESCRIPTION OF THE PREFERRED EMBODIMENT

Figure 1:
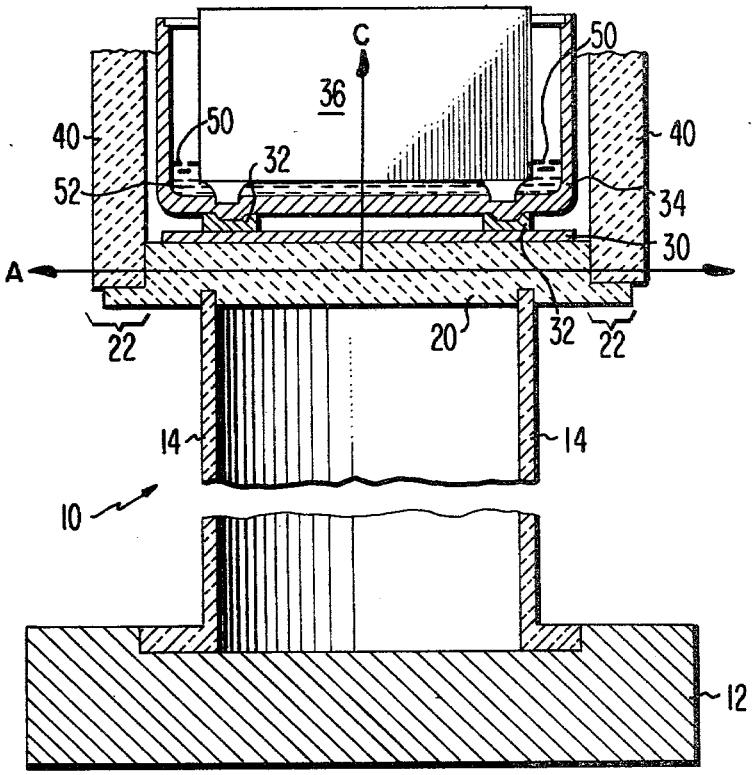
FIG. 1 is a cross section illustrating the crucible support system of the present invention.

In FIG. 1, the preferred embodiment of a crucible support system in accordance with this invention is illustrated generally at 10 and comprises a base 12 which is not exposed to high temperatures, a support pedestal 14 and a pyrolytic graphite crucible support plate 20.

Pyrolytic graphite is a polycrystalline form of carbon with a well oriented structure. It is formed by the carbon deposition on a surface by the decomposition of a carbonaceous gas, e.g., methane, in a process that is carried out at very high temperatures (usually above 2200° C.). The resulting material, pyrolytic graphite, is deposited in basal planes, contains no binder, has high purity and a density that normally exceeds 99.5% of the theoretical density of conventional graphite.

Pyrolytic graphite behaves like a metal in its basal planes (parallel to the surface of deposition), but is like a ceramic material across these planes. The basal planes consist of strongly bonded atoms within each plane but adjacent planes are held together by only weak bonding forces between the planes. The thermal and electric conductivities in the basal planes are 100 to 1,000 times greater than those across these planes. The properties of a sheet of pyrolytic graphite thus exhibit marked directionality, and it is, therefore, necessary to specify the direction of measurement for each of its characteristics.

Figure 2:
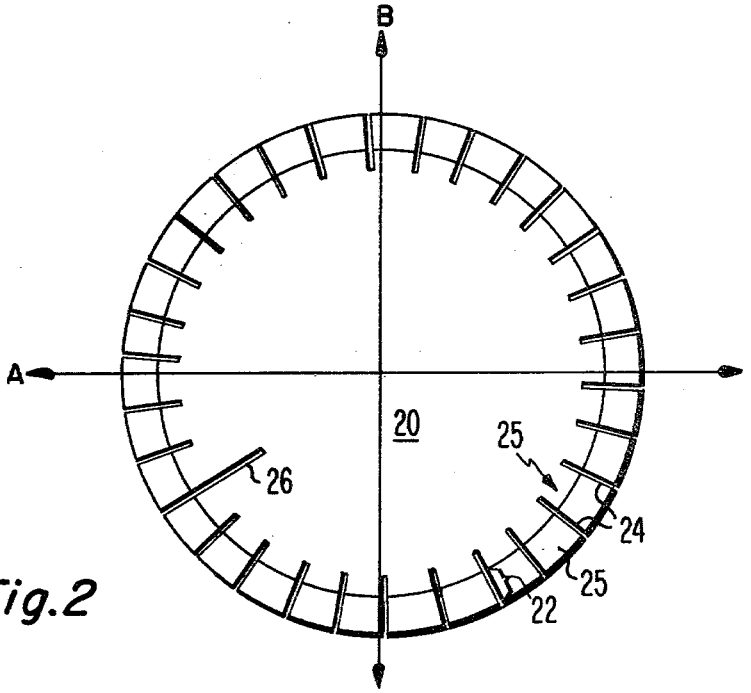
FIG. 2 is a plan view of the pyrolytic graphite crucible support plate portion of the crucible support system.

A sheet of pyrolytic graphite may be described as having three directional axes. An A-axis and a B-axis which are parallel to the surface of deposition of the basal planes and perpendicular to each other as best seen in FIG. 2. A C-axis of the sheet is perpendicular to both the A-axis and the B-axis and to the basal planes as best seen in FIG. 1.

The thermal properties of pyrolytic graphite are strongly affected by its structural anisotropy. Pyrolytic graphite acts as an excellent heat insulator in the C-axis direction and as a relatively good heat conductor in the planes containing the A and B axes (directions). The thermal conductivity of the pyrolytic graphite is about equal to that of copper at room temperature, but because it is highly anisotropic, the ratio of the thermal conductivity in the A and B axes directions to that in the C-axis direction is about 200 to 1.

Base 12 may comprise a dielectric or a metal and may preferably be aluminum. Support pedestal 14 is preferably a clear fused silica tube which rests on base 12 and is preferably retained in an accurately aligned position via alignment features (not shown) of the tube and the base. The pyrolytic graphite crucible support plate 20 rests on the upper end of support tube 14. The C axis of the pyrolytic graphite of the crucible support plate 20 is vertical, that is perpendicular to the bottom of the crucible as illustrated in FIG. 1 and the A and B axes are parallel to the bottom of the crucible as best seen in FIG. 2. The support plate 20 and the tube 14 are also preferably retained in accurately aligned position by alignment features (not shown) of the tube and the support plate.

A tungsten isolator plate 30 rests on the upper surface of the pyrolytic graphite support plate 20 and in turn supports a molybdenum spacing ring 32. The molybdenum spacing ring 32 supports a molybdenum crucible 34 which contains the EFG die 36 which controls the shape of the sapphire ribbon grown from the crucible. The die 36, the crucible 34, the spacer ring 32 and the tungsten plate 30 are all preferably keyed together and with the pyrolytic graphite crucible support plate 20 to retain the die 36 in an accurately aligned position with the respect to the base 12. This accurately aligns the length of the die growth control surface parallel to the crystallographic plane of the seed crystal which it is desired to have as the major face of the ribbon to be grown, without the need for repetitive test runs to establish orientation.

In order to obtain excellent control over growth conditions and the highest quality crystal growth, the support tube 14, the support plate 20, the crucible 34 and the die 36 are all fabricated to close tolerances. The tolerances on the support tube 14 and the support plate 20 are preferably ±5 mils (±0.127 millimeters) or less. The tolerances on the crucible and die are preferably ±1 mil (±0.0254 millimeters) or less. The support system of this invention is used very successfully in a system for growing 3 inch (7.62 centimeter) wide ribbons of sapphire.

Molybdenum and carbon form a liquid eutectic solution at a temperature which is reached or very nearly reached by the crucible/pyrolytic graphite interface during the sapphire growth. Consequently, when a molybdenum crucible is used, the presence of the tungsten isolator plate 30 is preferred in order to protect the crucible and the pyrolytic graphite from each other. If a tungsten crucible is used, the plate 30 may be omitted. The spacing ring 32 is provided in order to reduce stresses on the crucible which result from the thermal coefficient of expansion mismatch between tungsten and molybdenum and to provide space for the bottom of the crucible 34 to flex as its temperature changes.

Support plate 20 preferably has an exterior shoulder 22 for supporting a tubular grafoil or other sinterable heat shield 40 which restricts radiation heat losses from the crucible and thereby aids in maintaining an appropriate thermal profile for the growth of sapphire ribbons by the EFG process. If desired, heat shield 40 may be fabricated of pyrolytic graphite which has its C axis radially disposed to minimize its coupling to the induction heating system and to thereby maximize energy efficiency.

Fused silica support tube 14 is preferably about 6 inches long in order to allow the crucible to be properly positioned within the glassware of the furnace. A longer or shorter tube may be used if desired. Because an induction heating coil which is relatively thin from top to bottom is used for heating the crucible, the temperature at the top of the die and the thermal profile along the top of the die are both quite sensitive to the vertical position of the crucible relative to the induction coil. The fused silica of the support tube 14 has a very small ($5.5\times10^{-7}$ in/in/degree C.) thermal coefficient of expansion along the length of the tube and thus the position of the die changes only very slightly as the crucible is heated. With a fused silica support tube, the uncertainty in the crucible's position is a fraction (less than about 10) of the uncertainty when a prior art refractory rod support system is used in which the support rods have a substantial length and a substantial coefficient of thermal expansion (e.g., tungsten's thermal expansion coefficient is $5.5\times10^{-6}$ in/in/degree C.).

The temperature of the silica is kept below or only slightly above its softening point by a combination of the fact that it is an insulator and thus is not heated by the induction field and the fact that the pyrolytic graphite support plate has its C axis parallel to the axis of the silica or quartz tube. This positions the plane containing the A and B directions substantially parallel to the free surface 50 of the melt 52 in the crucible. Pyrolytic graphite conducts very little heat parallel to its C axis, see U.S. Pat. No. 3,096,083. Consequently, even where the pyrolytic graphite support plate is only ½ inch thick, the temperature at the lower surface of the pyrolytic graphite can be in the neighborhood of about 1100°–1200° C. despite the face that the temperature at the upper surface of the pyrolytic graphite support plate is at least 2000° C. Thus, the upper edge of the support tube may be at a temperature of as much as 1100°–1200° C., a temperature at which there is not significant deformation. The temperature decreases rapidly along the length of the support tube below the support plate and the temperature of the main part of the support tube is well below 1000° C. Thus, with the pyrolytic graphite crucible support plate insulating the pedestal from the crucible, the pedestal is not subjected to the very high temperatures experienced by the upper ends of the prior art tungsten rods.

Fused silica softens (anneals) at 1140° C., but can be used structurally at temperatures up to about 1250° C. or possibly 1300° C., if the resulting slow deformation of the tube can be tolerated. Silica melts at about 1665° C. and thus cannot be used to directly support a conventional graphite susceptor in a crystal growth system using growth temperatures which would cause the temperature of the silica to rise to temperatures in excess of about 1300° C. and certainly not in excess of 1500° C.

Th support system in accordance with the present invention provides extremely stable support for the crucible since the silica tube 14 may have a diameter of about 3 inches for a crucible having an inner diameter of about 3 inches.

As illustrated in the plan view of the pyrolytic graphite support plate 20 in FIG. 2, the support plate 20 is preferably provided with a plurality of radial slits 24 extending completely through the plate in a vertical direction along the outer periphery of the plate in a radially inwardly extending manner whereby any current heating in the exterior portion of the plate is minimized. This minimization is accomplished by spacing the slits 24 a distance apart which is less than about 2 skin depths at the induction heating frequency. This close spacing of the slits causes cancellation of oppositely directed radially running eddy currents in each peninsula 25 bounded by two slits. The single long slit 26 is provided to minimize the circumferentially running eddy current closer to the center of the support plate 20. The slits 24 preferably extend radially inward from the periphery of the disk at least as far as the outer edge of the crucible 34.

Using this support structure, flat top dies have been successfully used to grow three inch (7.62 cm) wide ribbons from 3.50 (8.89 cm) inch inner diameter crucibles. This success is believed to be at least partially a result of reduced heat losses due to a substantial reduction in thermal conduction down the length of the support pedestal which occurs with prior art refractory metal pedestabls.

Thus, an improved, more stable, crucible support system for use in EFG sapphire growth has been disclosed and described. Various modifications can be made in the preferred embodiment without departing from the scope of the invention as defined in the appended claims. The support system may be used for the growth of materials other than sapphire and with processes other than EFG as long as inert conditions (including a vacuum or an inert atmosphere) are maintained during growth.

What is claimed is:

1. A crucible support structure for supporting a crucible which is to be heated to at least 1800° C. comprising:

a pyrolytic graphite crucible support plate having a support surface for supporting said crucible;

support means for supporting the surface of said pyrolytic graphite crucible support plate opposite said support surface, said support means being made of a material having a relatively low coefficient of thermal expansion and a softening point of about 1140° C. and being usable to retain said support surface in a relatively stable position when the temperature of said support means does not exceed about 1300° C.;

the C axis of said pyrolytic graphite crucible support plate extending between said support surface and said opposite surface such that it is substantially perpendicular to the bottom of said crucible; and said pyrolytic graphite having a thickness about said support surface and said opposite surface to prevent the portion of said support means engaged with said opposite surface from rising to a temperature in excess of about 1300° C. even when said support crucible is maintained at a temperature in excess of 1800° C.

2. The crucible support structure recited in claim 1 wherein said support means comprises a fused silica pedestal.

3. The crucible support structure recited in claim 2 wherein said pedestal comprises a fused silica tube.

4. The crucible support structure recited in claim 3 wherein said pyrolytic graphite crucible support plate is thick enough so that the main body of said silica pedestal is maintained at a temperature of less than 1000° C. where the crucible is at a temperature of 1800° C.

5. The support structure recited in claim 3 wherein said tube is cylindrical.

6. The support structure recited in claim 1 wherein said support means comprises a fused silicon tube.

7. The crucible support structure recited in claim 1 further comprising a metal plate on said support surface for spacing said crucible from said pyrolytic graphite crucible support plate.

8. The crucible support structure recited in claim 7 wherein said metal plate comprises tungsten and said structure further comprises a molybdenum ring spacing said crucible from said tungsten plate.

9. The crucible support structure recited in claim 1 wherein said structure is capable of stably supporting a crucible which is maintained at a temperature of at least 2100° C.

10. The crucible support recited in claim 1 wherein:

said pryolytic graphite crucible support plate is substantially circular disk;

a plurality of substantially radially inwardly extending slits are spaced along the periphery of said disk; and said slits extend through the thickness of said disk.

11. The crucible support structure recited in claim 10 wherein said slits extend radially inward from the periphery of said disk at least as far as the expected location of the wall of the crucible to be supported by said plate.

12. The crucible support recited in claim 1 including a sinterable heat shield supported on the outer periphery of said support surface such that it surrounds said crucible.

13. The crucible support recited in claim 12 wherein said sinterable heat shield is made of pyrolytic graphite having its C axis extending generally perpendicular to the C axis of said pyrolytic graphite crucible support plate.

14. A method of supporting a crucible which is at a temperature of at least 1800° C. comprising:

providing a pyrolytic graphite crucible support plate for supporting said crucible on a support surface thereon;

supporting said pyrolytic graphite crucible support plate on a support pedestal made of a material having a relatively low coefficient of thermal expansion and a softening point of about 1140° C. and being usable to retain said support surface in a relatively stable position when the temperature of said support means does not exceed about 1300° C. by resting the face of said pyrolytic graphite crucible support plate opposite said support surface on an end portion of said support means;

orienting said pyrolytic graphite crucible support plate so that the C axis of said pyrolytic graphite extends between said support surface and said opposite surface and is perpendicular to the bottom of a crucible supported thereby; and said pyrolytic graphite having a sufficient thickness between said support surface and said opposite surface to maintain the temperature of said end portion of the pedestal at a temperature of less than about 1300° C. when said crucible is maintained at a temperature of at least 1800° C.

15. The method recited in claim 14 wherein the main body of said pedestal is maintained at a temperature of less than 1000° C.

16. The method recited in claim 14 wherein said pedestal is comprised of fused silica.

* * * * *

UNITED STATES PATENT AND TRADEMARK OFFICE
CERTIFICATE OF CORRECTION

PATENT NO. : 4,251,206

DATED : February 17, 1981

INVENTOR(S) : Samuel Berkman et al.

It is certified that error appears in the above-identified patent and that said Letters Patent is hereby corrected as shown below:

| | |
|---|---|
| Column 1, line 17: | "Edge-defined Film-fed Growth" should be --Edge-defined Film-fed Growth-- |
| Column 3, line 59: | "10" should be --10%-- |
| Column 4, line 9 : | "face" should be --fact-- |
| line 61: | "pedestabls" should be --pedestals-- |
| Column 5, line 23: | "about" should be --between-- |
| line 29: | "support" should be --supported-- |
| Column 6, line 3 : | after "support" insert --structure-- |

Signed and Sealed this

*Twenty-sixth* Day of *May 1981*

[SEAL]

*Attest:*

RENE D. TEGTMEYER

*Attesting Officer*

*Acting Commissioner of Patents and Trademarks*